US010869555B2

(12) United States Patent
Jones

(10) Patent No.: US 10,869,555 B2
(45) Date of Patent: Dec. 22, 2020

(54) MOTORIZED CHAIR ASSEMBLY

(71) Applicant: Marshea Jones, Lawrenceville, GA (US)

(72) Inventor: Marshea Jones, Lawrenceville, GA (US)

( * ) Notice: Subject to any disclaimer, the term of this patent is extended or adjusted under 35 U.S.C. 154(b) by 0 days.

(21) Appl. No.: 16/030,388

(22) Filed: Jul. 9, 2018

(65) Prior Publication Data

US 2020/0008581 A1 Jan. 9, 2020

(51) Int. Cl.
*A47C 7/50* (2006.01)
*A47C 7/74* (2006.01)

(52) U.S. Cl.
CPC ..... *A47C 7/5062* (2018.08); *A47C 7/5066* (2018.08); *A47C 7/748* (2013.01)

(58) Field of Classification Search
CPC ..... A47C 7/5062; A47C 7/5066; A47C 7/748
See application file for complete search history.

(56) References Cited

U.S. PATENT DOCUMENTS

| | | | | |
|---|---|---|---|---|
| 2,526,623 | A | 10/1950 | Maurer | |
| 3,379,471 | A | 4/1968 | Dalziel | |
| 3,794,381 | A * | 2/1974 | Caldemeyer | A47C 7/506 297/423.22 |
| 4,860,393 | A | 8/1989 | Schefthaler | |
| 7,083,235 | B2 | 8/2006 | Grimm | |
| 7,547,072 | B1 | 6/2009 | Delmestri | |
| 2005/0052067 | A1* | 3/2005 | Grimm | A47C 1/03211 297/423.2 |
| 2018/0339632 | A1* | 11/2018 | Akaike | B60N 3/063 |

* cited by examiner

*Primary Examiner* — Anthony D Barfield

(57) ABSTRACT

A motorized chair assembly for reducing floor space occupied by a reclining chair includes a chair that has a seat portion, a backrest portion and a pair of armrests. A foot rest is slidably coupled to the seat portion of the chair. The foot rest is positionable in a deployed position having the foot rest extending forwardly from the seat portion and being oriented parallel to ground for resting feet thereon. The foot rest is positionable in a stored position having the foot rest being retracted within the seat portion. A panel is hingedly coupled to the foot rest. The panel is positionable at a selected angle with respect to the foot rest when the foot rest is deployed wherein the panel is configured to have feet rested thereon.

1 Claim, 7 Drawing Sheets

MOTORIZED CHAIR ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to chair devices and more particularly pertains to a new chair device for reducing floor space occupied by a reclining chair.

BRIEF SUMMARY OF THE INVENTION

An embodiment of the disclosure meets the needs presented above by generally comprising a chair that has a seat portion, a backrest portion and a pair of armrests. A foot rest is slidably coupled to the seat portion of the chair. The foot rest is positionable in a deployed position having the foot rest extending forwardly from the seat portion and being oriented parallel to ground for resting feet thereon. The foot rest is positionable in a stored position having the foot rest being retracted within the seat portion. A panel is hingedly coupled to the foot rest. The panel is positionable at a selected angle with respect to the foot rest when the foot rest is deployed wherein the panel is configured to have feet rested thereon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
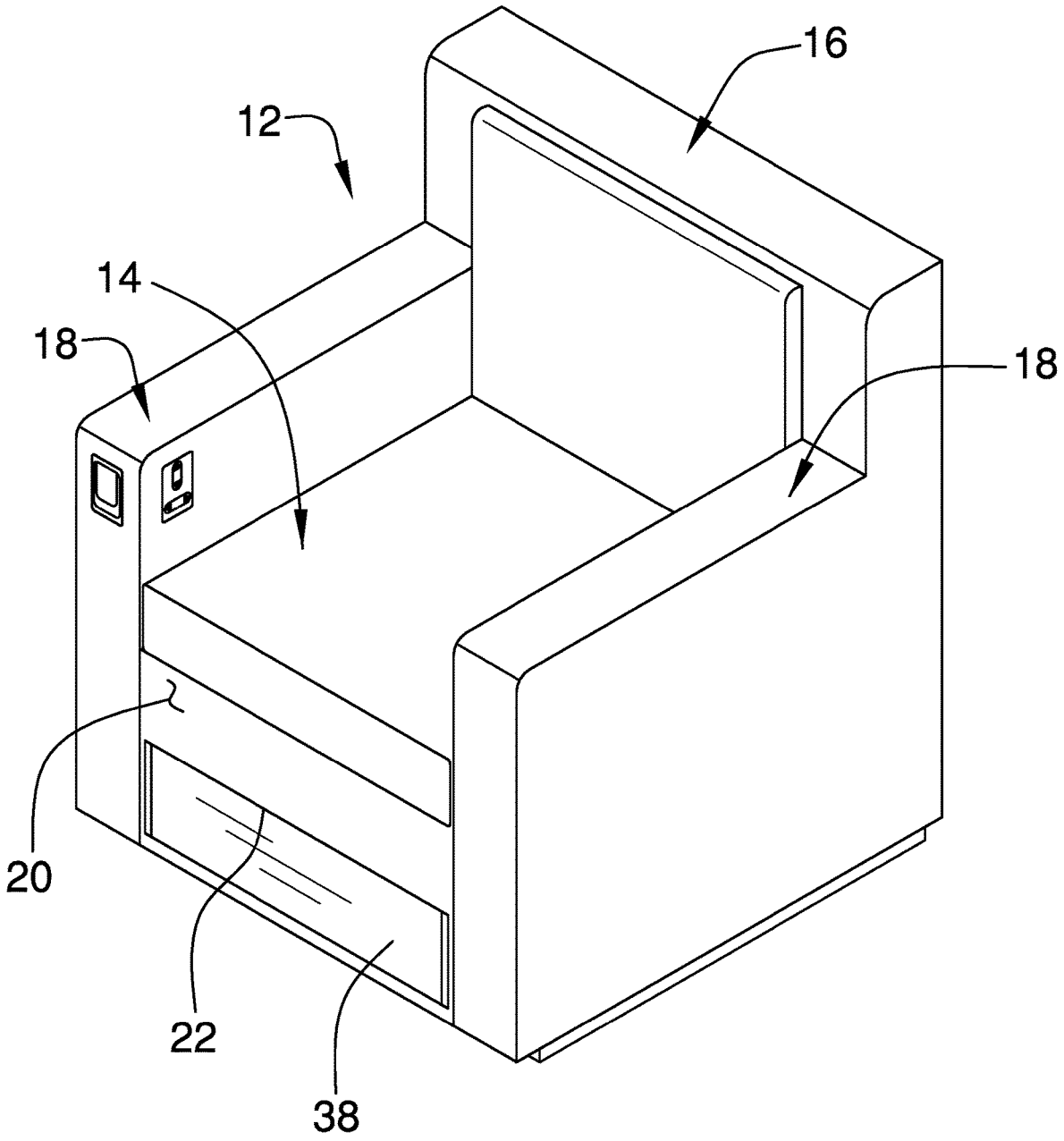
FIG. 1 is a top perspective view of a motorized chair assembly according to an embodiment of the disclosure showing a foot rest is a stored position.
Figure 2:
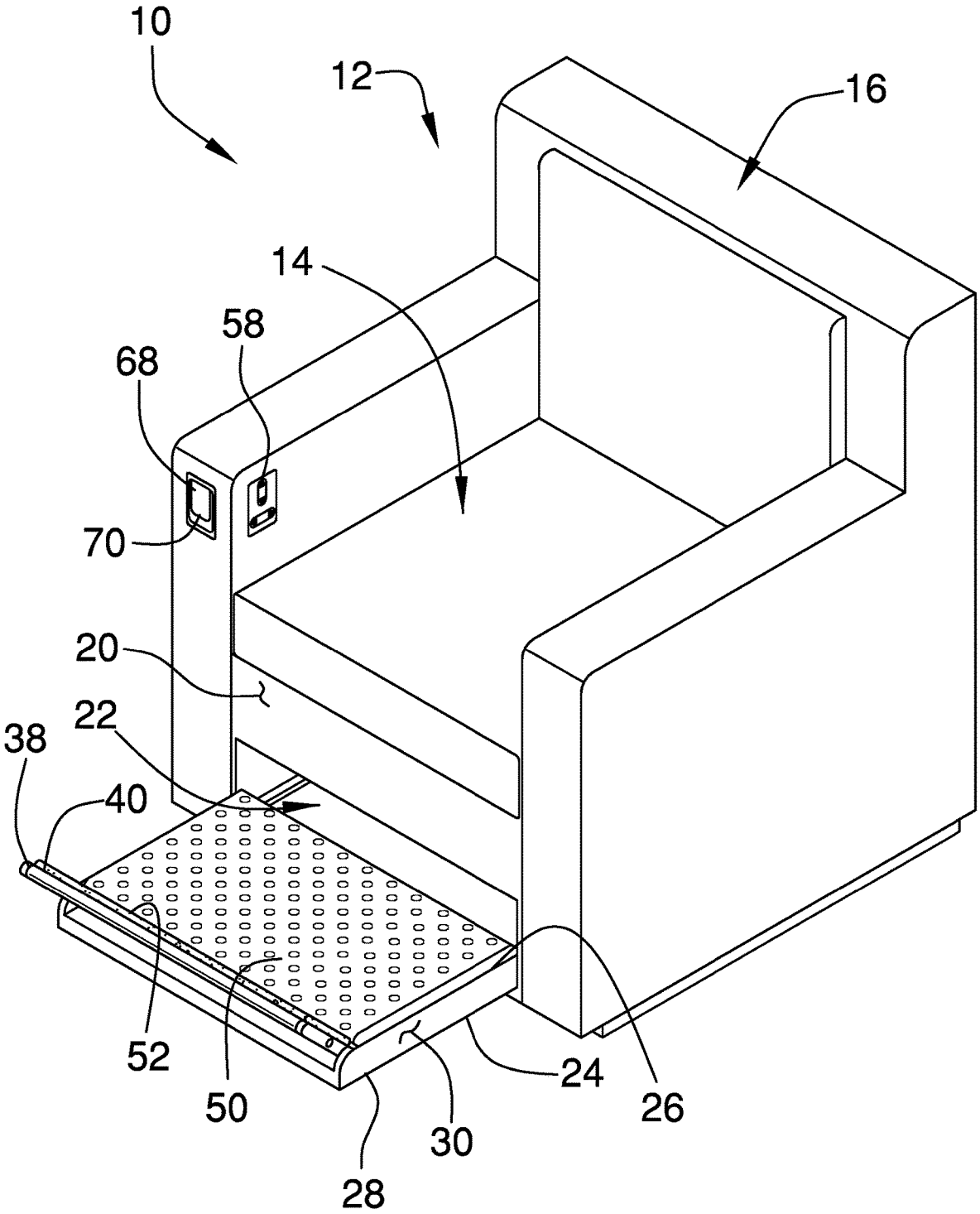
FIG. 2 is a perspective view of an embodiment of the disclosure showing a foot rest in a deployed position.
Figure 3:
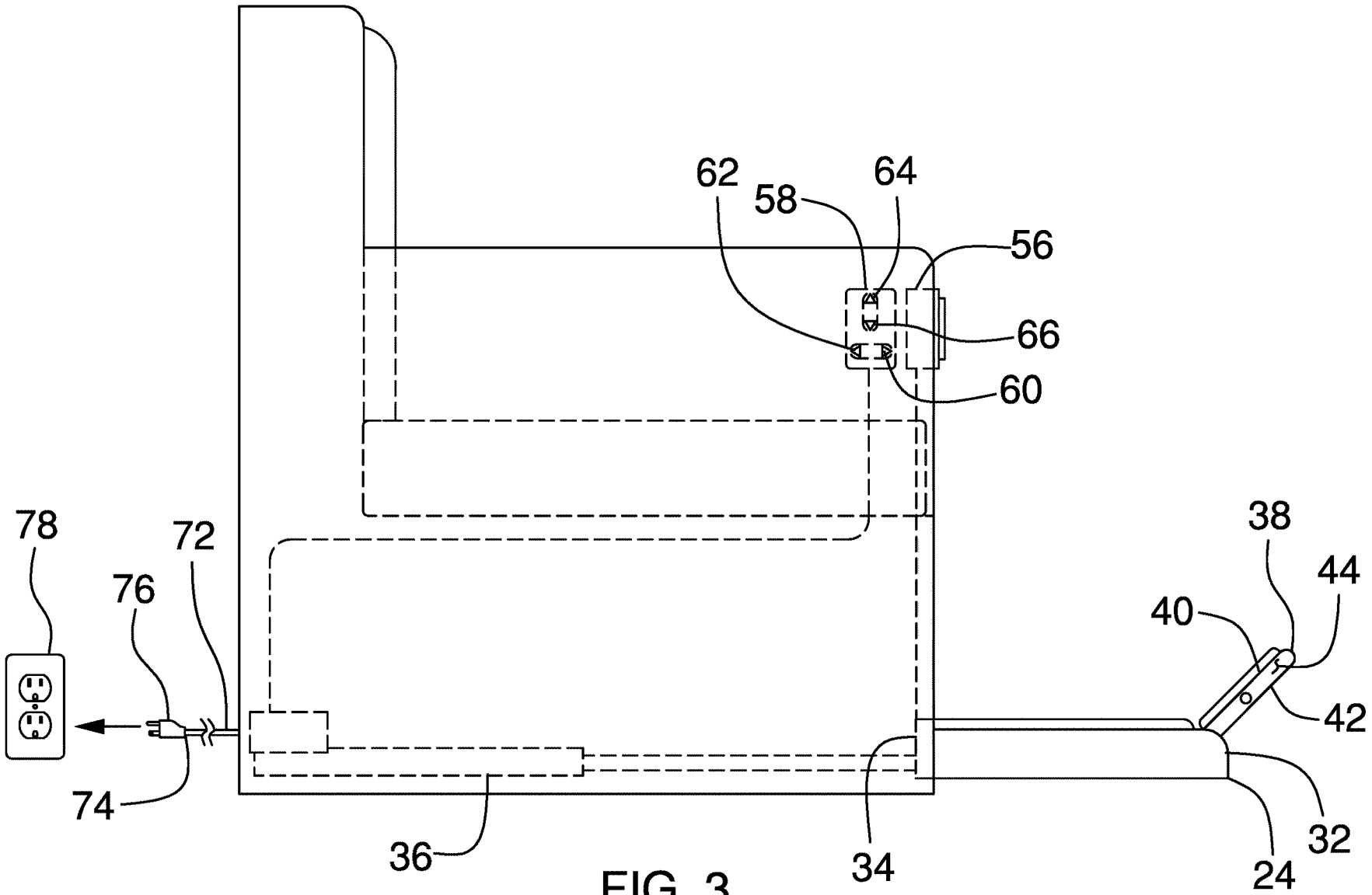
FIG. 3 is a right side phantom view of an embodiment of the disclosure.
Figure 4:
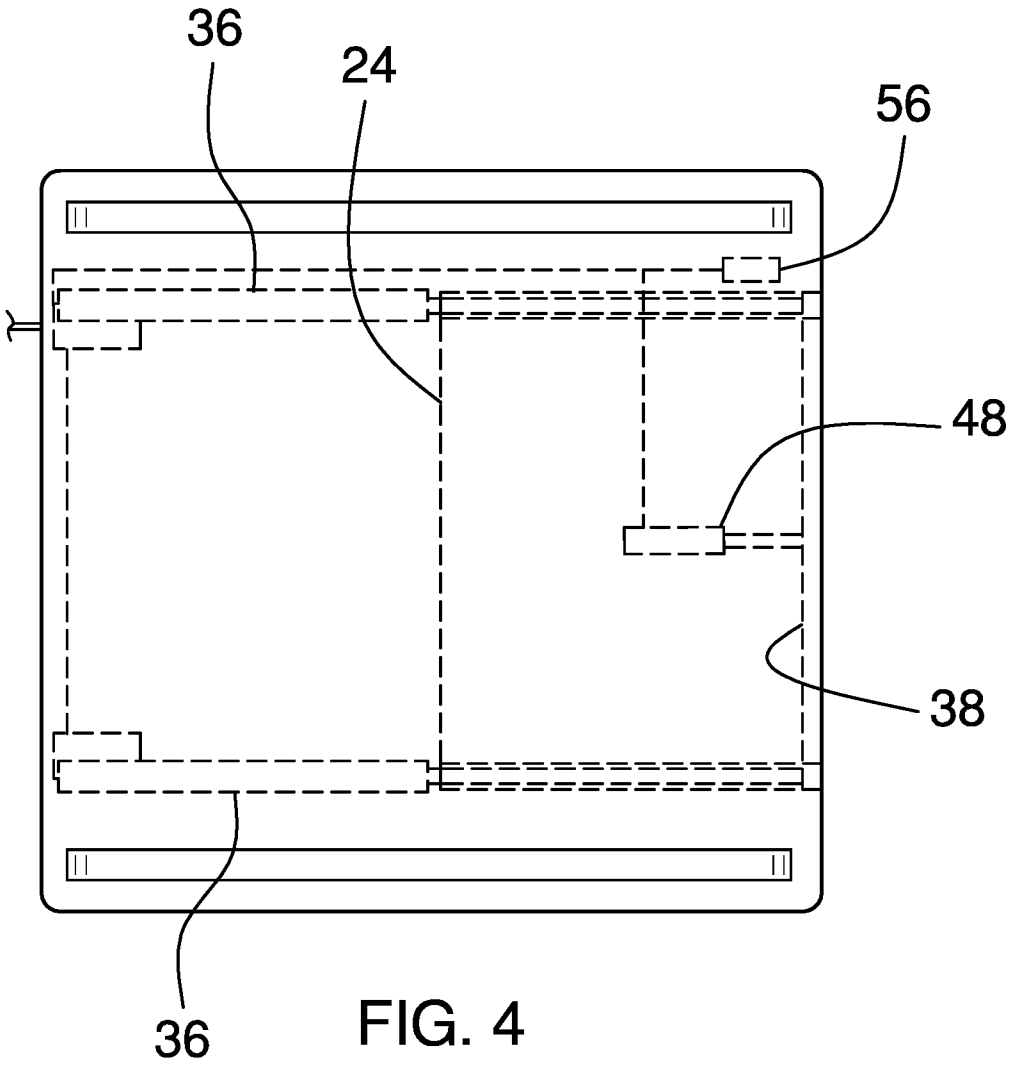
FIG. 4 is a bottom phantom view of an embodiment of the disclosure.
Figure 5:
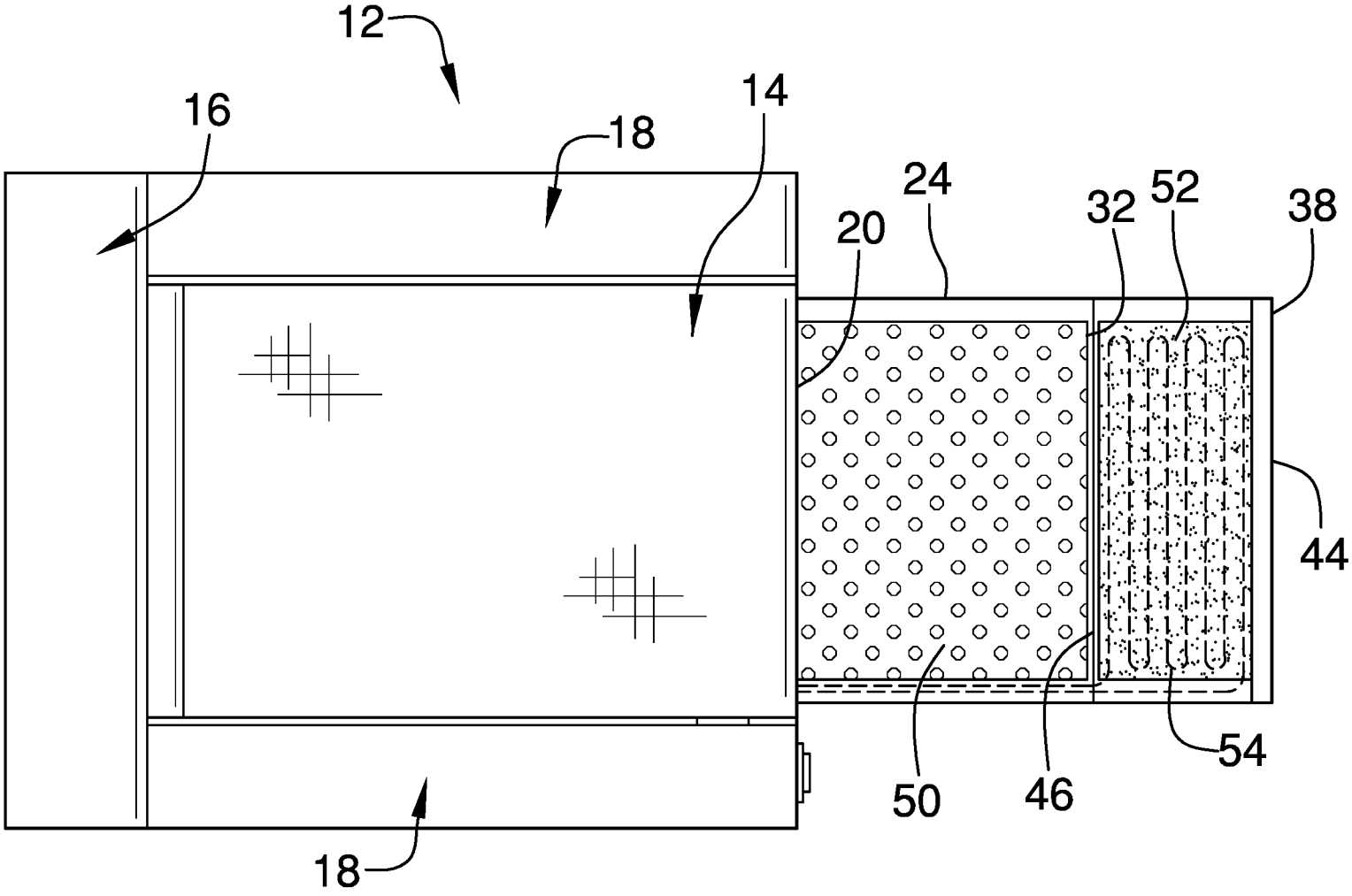
FIG. 5 is a top view of an embodiment of the disclosure.
Figure 6:
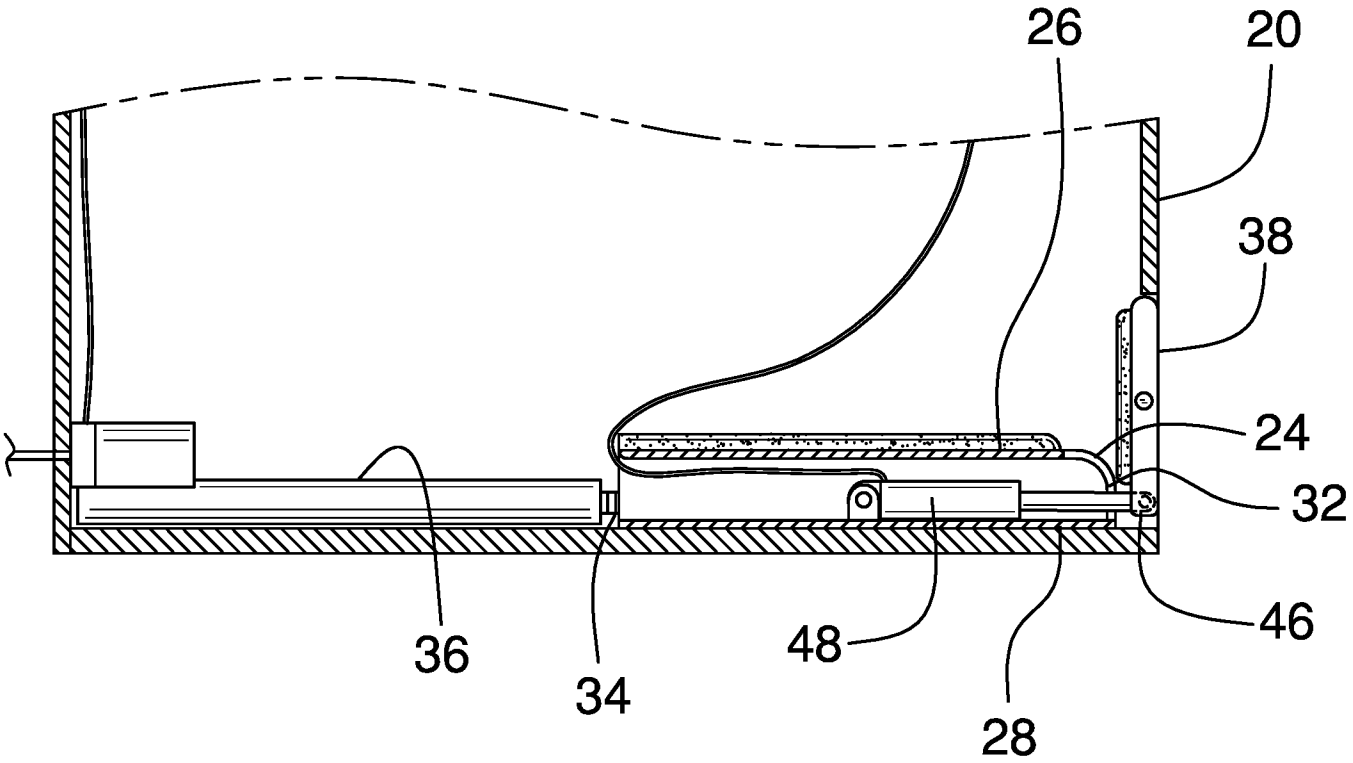
FIG. 6 is a right side cut-away view view of an embodiment of the disclosure showing a foot rest in a stored position.
Figure 7:
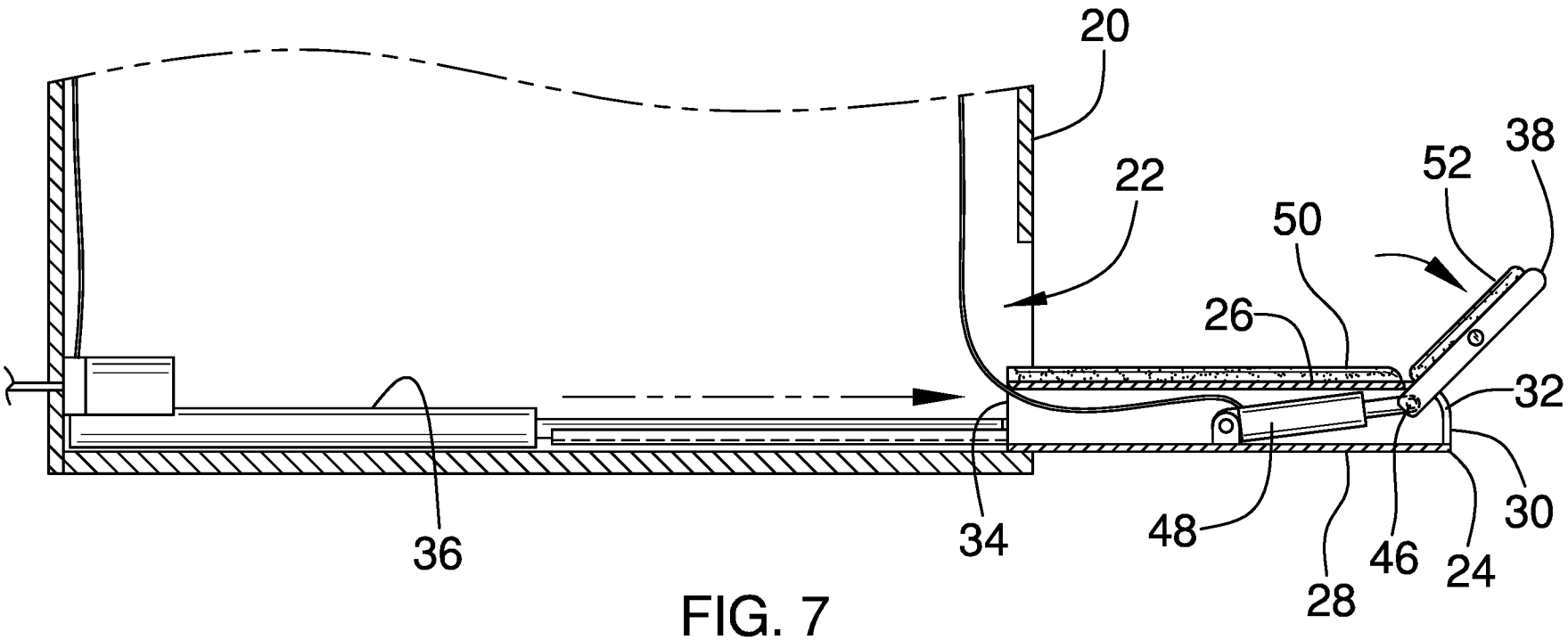
FIG. 7 is a right side cut-away view of an embodiment of the disclosure showing a foot rest in a deployed position.

With reference now to the drawings, and in particular to FIGS. 1 through 7 thereof, a new chair device embodying the principles and concepts of an embodiment of the disclosure and generally designated by the reference numeral 10 will be described.

As best illustrated in FIGS. 1 through 7, the motorized chair assembly 10 generally comprises a chair 12 has a seat portion 14, a backrest portion 16 and a pair of armrests 18. The seat portion 14 has a front surface 20, the seat portion 14 is hollow and the front surface 20 has an opening 22 extending into an interior of the seat portion 14. The chair 12 may be structured to resemble a recliner chair, such as a Lay Z Boy recliner or the like. A foot rest 24 is slidably coupled to the seat portion 14 of the chair 12. The foot rest 24 is positionable in a deployed position having the foot rest 24 extending forwardly from the seat portion 14 and being oriented parallel to ground for having feet rested thereon. Moreover, the foot rest 24 is positionable in a stored position having the foot rest 24 being retracted within the seat portion 14.

The foot rest 24 has a top surface 26, a bottom surface 28 and a peripheral surface 30 extending therebetween, and the peripheral surface 30 has a front side 32 and a back side 34. A first actuator 36 is positioned within the seat portion 14 of the chair 12 and the first actuator 36 is coupled between the seat portion 14 and the back side 34 of the peripheral surface 30 of the foot rest 24. The first actuator 36 urges the foot rest 24 outwardly through the opening 22 in the front surface 20 of the chair 12 portion when the foot rest 24 is positioned in the deployed position. Alternatively, the first actuator 36 retracts the foot rest 24 inwardly through the opening 22 in the front surface 20 when the foot rest 24 is positioned in the stored position.

A panel 38 is hingedly coupled to the foot rest 24. The panel 38 is positionable at a selected angle with respect to the foot rest 24 when the foot rest 24 is deployed. In this way the panel 38 facilitates an addition surface to have feet rested thereon. The panel 38 has an upper surface 40, a lower surface 42 and a perimeter surface 44 extending therebetween, and the perimeter surface 44 has a rear side 46. The rear side 46 is hingedly coupled to the front side 32 of the peripheral surface 30 of the foot rest 24 and the upper surface 40 of the panel 38 is positionable at a selected angle with respect to the top surface 26 of the foot rest 24. Moreover, the panel 38 is oriented perpendicular to the foot rest 24 when the foot rest 24 is urged into the stored position such that the panel 38 closes the opening 22 through which the foot rest 24 extends and retracts.

A second actuator 48 is positioned within the foot rest 24 and the second actuator 48 is coupled between the foot rest 24 and the rear side 46 of the perimeter surface 44 of the panel 38. The second actuator 48 urges the panel 38 back and forth to adjust the angle of the panel 38. Each of the first and second actuator 48*s* may be hydraulic pistons, electronic linear actuators and any other sort of mechanical actuator. Additionally, the bottom surface 28 of the foot rest 24 may rollably engage the chair 12 portion via a pair of tracks, rollers on the bottom surface 28 or any other conventional means of frictionless, linear motion.

A first pad 50 is coupled to the top surface 26 of the foot rest 24 and the first pad 50 is comprised of a resiliently compressible material for enhancing comfort of the foot rest 24. A second pad 52 is coupled to the upper surface 40 of the panel 38 and the second pad 52 is comprised of a resiliently compressible material for enhancing comfort of the panel 38. A heating element 54 is positioned within the panel 38 and the heating element 54 is in thermal communication with the panel 38. Thus, the heating element 54 heats the panel 38 when the heating element 54 is turned on for warming the feet for the purposes of heat therapy or for pleasure. The heating element 54 may be an electrical heating coil or the like with an operational temperature ranging between approximately 90.0 degrees Fahrenheit and 110.0 degrees Fahrenheit.

A control circuit 56 is coupled to the chair 12 and each of the first 36 and second 48 actuators is electrically coupled to the control circuit 56. A control 58 is coupled to the chair 12 and the control 58 is electrically coupled to the control circuit 56. The control 58 may include an extend control 60, a retract control 62, a decrease angle control 64, an increase angle control 66, a heat on control 68 and a heat off control 70. Each of the extend 60, retract 62, decrease angle 64, increase angle 66, heat on 68 and heat off 70 controls may be slidable switches, touch sensitive pads and any other type of electronic control 58.

The foot rest 24 is urged into the deployed position when the extend control 60 is manipulated and the foot rest 24 is urged into the stored position when the retract control 58 is manipulated. The panel 38 is angled forwardly on the foot rest 24 when the angle increase control 58 is manipulated and the panel 38 is angled rearwardly on the foot rest 24 when the angle decrease control 58 is manipulated. The heating element 54 is turned on and off when respective ones of the heat on 68 and the heat off 70 controls are manipulated. A power cord 72 is coupled to the chair 12 and the power cord 72 is electrically coupled to the control circuit 56. The power cord 72 has a distal end 74 with respect to the chair 12, the distal end 74 has a plug 76 electrically coupled thereto and the plug 76 is electrically coupled to a power source 78, such as a female electrical outlet or the like.

In use, the chair 12 is positioned in a selected area in a room for sitting or for decorative purposes. The extend control 60 is manipulated to extend the foot rest 24 outwardly from the seat portion 14 of the chair 12. Thus, the foot rest 24 can support feet of a user that is sitting in the chair 12. Each of the increase angle 66 and decrease angle 64 controls can be manipulated to position the panel 38 at a selected angle on the foot rest 24. Thus, the feet can be rested on the panel 38 according to the user's preferences. The heating element 54 can be turned on to heat the panel 38 and thusly warm the user's feet for therapeutic purposes or for pleasure. The panel 38 closes the opening 22 when the foot rest 24 is fully retracted into the chair 12 portion. In this way the chair 12 occupies less floor space than a traditional recliner with respect the extending and retracting the foot rest 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motorized chair assembly having a footrest being extendable outwardly and retractable inwardly, said assembly comprising:

a chair having a seat portion, a backrest portion and a pair of armrests, said seat portion having a front surface, said seat portion being hollow, said front surface having an opening extending into an interior of said seat portion;

a foot rest being slidably coupled to said seat portion of said chair, said foot rest being positionable in a deployed position having said foot rest extending forwardly from said seat portion and being oriented parallel to ground wherein said foot rest is configured to have feet rested thereon, said foot rest being positionable in a stored position having said foot rest being retracted within said seat portion, said foot rest having a top surface, a bottom surface and a peripheral surface extending therebetween, said peripheral surface having a front side and a back side;

a first actuator being positioned within said seat portion of said chair, said first actuator being coupled between said seat portion and said back side of said peripheral surface of said foot rest, said first actuator urging said foot rest outwardly through said opening in said front surface of said chair portion when said foot rest is positioned in said deployed position, said first actuator retracing said foot rest inwardly through said opening in said front surface when said foot rest is positioned in said stored position;

a panel being hingedly coupled to said foot rest, said panel being positionable at a selected angle with respect to said foot rest when said foot rest is deployed wherein said panel is configured to have feet rested thereon, said panel having an upper surface, a lower surface and a perimeter surface extending therebetween, said perimeter surface having a rear side, said rear side being hingedly coupled to said front side of said peripheral surface of said foot rest, said upper surface of said panel being positionable at a selected angle with respect to said top surface of said foot rest, said panel being oriented perpendicular to said foot rest when said foot rest is urged into said stored position such that said panel closes said opening through which said foot rest extends and retracts;

a second actuator being positioned within said foot rest, said second actuator being coupled between said foot rest and said rear side of said perimeter surface of said panel, said second actuator urging said panel back and forth to adjust said angle of said panel;

a first pad being coupled to said top surface of said foot rest, said first pad being comprised of a resiliently compressible material for enhancing comfort of said foot rest;

a second pad being coupled to said upper surface of said panel, said second pad being comprised of a resiliently compressible material for enhancing comfort of said panel;

a heating element being positioned within said panel, said heating element being in thermal communication with said panel, said heating element heating said panel when said heating element is turned on wherein said heating element is configured to warm the feet;

a control circuit being coupled to said chair, said control circuit having each of said first and second actuators being electrically coupled thereto;

a control being coupled to said chair, said control being electrically coupled to said control circuit, said control comprising an extend control, a retract control, a decrease angle control, an increase angle control, a heat on control and a heat off control, said foot rest being urged into said deployed position when said extend control is manipulated, said foot rest being urged into said stored position when said retract control is manipulated, said panel being angled forwardly on said foot rest when said angle increase control is manipulated, said panel being angled rearwardly on said foot rest when said angle decrease control is manipulated, said heating element being turned on and off when respective ones of said heat on and said heat off controls are manipulated; and a power cord being coupled to said chair, said power cord being electrically coupled to said control circuit, said power cord having a distal end with respect to said chair, said distal end having a plug being electrically coupled thereto, said plug being electrically coupled to a power source.

* * * * *